US012246366B2

(12) United States Patent
Gao et al.

(10) Patent No.: US 12,246,366 B2
(45) Date of Patent: Mar. 11, 2025

(54) INTERMEDIATE BLANK CONNECTION SYSTEM FOR HOT-ROLLED STRIP HEADLESS ROLLING AND CONNECTION METHOD

(71) Applicant: CISDI Research & Development Co., Ltd., Chongqing (CN)

(72) Inventors: Aimin Gao, Chongqing (CN); Huiquan Han, Chongqing (CN); Wanhui Wang, Chongqing (CN); Min Zhou, Chongqing (CN)

(73) Assignee: CISDI Research & Development Co., Ltd., Chongqing (CN)

( * ) Notice: Subject to any disclaimer, the term of this patent is extended or adjusted under 35 U.S.C. 154(b) by 259 days.

(21) Appl. No.: 17/635,708

(22) PCT Filed: Aug. 18, 2020

(86) PCT No.: PCT/CN2020/109835

§ 371 (c)(1),
(2) Date: Feb. 16, 2022

(87) PCT Pub. No.: WO2021/032091

PCT Pub. Date: Feb. 25, 2021

(65) Prior Publication Data

US 2022/0288660 A1 Sep. 15, 2022

(30) Foreign Application Priority Data

Aug. 22, 2019 (CN) ..... 201910779750.6

(51) Int. Cl.
*B21B 15/00* (2006.01)

(52) U.S. Cl.
CPC ..... *B21B 15/0007* (2013.01); *B21B 15/0085* (2013.01); *B21B 2015/0014* (2013.01)

(58) Field of Classification Search
CPC ..... B21B 2015/0014; B21B 15/0085; B21B 15/0007; B21B 15/00; B21D 39/03
See application file for complete search history.

(56) References Cited

FOREIGN PATENT DOCUMENTS

| | | | | |
|---|---|---|---|---|
| CN | 110479764 A | * | 11/2019 | ..... B21B 15/0007 |
| CN | 210754350 U | * | 6/2020 | ..... B21B 15/0007 |
| JP | 05146806 A | * | 6/1993 | |

OTHER PUBLICATIONS

Matsunuma Setsuo; JPH05146806A; Connecting Device for Rolled Stock; Jun. 15, 1993; EPO English Machine translation; pp. 1-4. (Year: 1993).*

* cited by examiner

*Primary Examiner* — Bayan Salone
(74) *Attorney, Agent, or Firm* — Michael D. Eisenberg

(57) ABSTRACT

The present invention relates to an intermediate blank connection system for hot-rolled strip headless rolling and a connection method, and belongs to the technical field of intermediate blank connection for strip steel headless rolling. The connection system and the connection method realize matching of an intermediate blank connection device and speed of a unit through a translation drive system. A mounting frame is used to provide support for cutting devices, and the cutting devices are divided into two groups arranged in the mounting frame to achieve clamping of a front slab and a rear slab respectively. Interlaced dovetail cutting edge structures are used to achieve cutting and ensure a good longitudinal stress state. Finally, a certain difference is set in sizes of width directions between cutting edges, to ensure that there is certain extrusion deformation in a process of forming dovetail cutting groove connection, and enhance a connection effect. At the same time of realizing a good intermediate blank connection effect finally, (Continued)

a structure of the connection device is greatly simplified, and investment and operating cost is reduced.

10 Claims, 2 Drawing Sheets

INTERMEDIATE BLANK CONNECTION SYSTEM FOR HOT-ROLLED STRIP HEADLESS ROLLING AND CONNECTION METHOD

FIELD OF INVENTION

The present invention belongs to the technical field of intermediate blank connection for strip steel headless rolling, and particularly relates to an intermediate blank connection system for hot-rolled strip headless rolling and a connection method.

BACKGROUND ART OF THE INVENTION

In the production of the traditional finishing mill group of hot strip rolling, a single intermediate blank is rolled. Processes of strip passing, accelerated rolling, decelerated rolling, steel throwing and tail throwing are inevitable during entry into the finishing mill group. Therefore, it is difficult to ensure a thickness difference between strip head and tail and uniformity of strip passing quality, and rolling operation rates and rolling yields are also limited.

As automobile and home appliance industries put forward higher requirements for quality of thin plates, size and shape precision, surface and internal quality have become quality keys of equal importance. A hot-rolled strip headless rolling technology shows incomparable advantages in ultra-thin hot strip rolling, control of plate thickness accuracy, stability control of entire length performance of sheet strip and productivity improvement.

Intermediate blank connection technologies are key technologies of headless rolling, currently including: a pack rolling crimping method, a cutting crimping method, a welding method, a mechanical connection method, a reducing flame treatment connection method, a direct electrification connection method, an induction heating connection method and a laser welding method. At present, the existing intermediate blank connection technologies are complex in structure, large in floor space and high in investment cost, and connection processes are very complex.

Studies on a clamping groove connection method have appeared in China and abroad, but a process flow of equipment is realized by "cutting clamping grooves for a front slab and a rear slab respectively and then conducting lapping extrusion". The process flow and connection equipment are not feasible to implement: on the one hand, for smooth extrusion, positioning accuracy of front and rear clamping grooves needs to be controlled in micron magnitude, and the positioning accuracy of online continuous production cannot satisfy this requirement. At the same time, due to cutting of the clamping grooves and lapping extrusion, cutting surfaces are exposed to the air for a long time, which will lead to generation of oxide layers and will also affect a connection effect.

BRIEF SUMMARY OF THE INVENTION

In view of this, a purpose of the present invention is to provide an intermediate blank connection system for hot-rolled strip headless rolling and a connection method, to satisfy an intermediate blank connection effect, simultaneously simplify a structure reduce cost.

To achieve the above purpose, the present invention provides following technical solution:

The intermediate blank connection system for hot-rolled strip headless rolling comprises an upper cutting device I, a lower cutting device I, an upper cutting device II and a lower cutting device II; the upper cutting device II and the lower cutting device II are located behind the upper cutting device I and the lower cutting device I;

The upper cutting device I comprises an upper knife stand I, an upper cutting edge I arranged on the upper knife stand I, an upper pressing mechanism I for driving the upper knife stand I to make up and down motion, and an upper translation mechanism I for driving the upper knife stand I to make forward and backward translational motion; the lower cutting device I is mainly comprised of a lower knife stand I and a lower cutting edge I arranged on the lower knife stand I;

The upper cutting device II comprises an upper knife stand II, an upper cutting edge II arranged on the upper knife stand II, and an upper pressing mechanism II for driving the upper knife stand II to make up and down motion; the lower cutting device II comprises a lower knife stand II, a lower cutting edge II arranged on the lower knife stand II, and a lifting mechanism for driving the lower knife stand II to make up and down motion;

The upper cutting edge I is arranged above the lower cutting edge I and the upper cutting edge I has a same cutting edge structure as the lower cutting edge I; the upper cutting edge II is arranged directly above the lower cutting edge II and the upper cutting edge II has a same cutting edge structure as the lower cutting edge II; the cutting edge structures of the upper cutting edge I and the lower cutting edge II are interlaced with each other to cut a front slab under cooperation, and the cutting edge structures of the lower cutting edge I and the upper cutting edge II are interlaced with each other to cut a rear slab under cooperation; and the upper pressing mechanism II is provided with a press quantity detection device for controlling the cutting amount of the upper cutting edge II and the lower cutting edge II.

Further, the intermediate blank connection system for hot-rolled strip headless rolling further comprises a mounting frame and a translation drive system; the translation drive system is connected with the mounting frame and drives the mounting frame to move forward and backward along an operating direction of a unit; the translation drive system is provided with a displacement detection device for controlling moving speed of the mounting frame in real time, so that the mounting frame is matched with speed of the unit; the upper cutting device I and the lower cutting device I are arranged on the mounting frame and located at an inlet end, and the upper cutting device II and the lower cutting device II are arranged on the mounting frame and located at an outlet end.

Further, the upper pressing mechanism I is installed on the upper translation mechanism I and is connected with the upper knife stand I, and the upper translation mechanism I is installed on the mounting frame; and the upper pressing mechanism II and the lifting mechanism are correspondingly connected with the upper knife stand II and the lower knife stand II and installed on the mounting frame.

Further, the lower cutting device I also comprises a lower translation mechanism I for driving the lower knife stand I to make forward and backward translation motion.

Further, the lower translation mechanism I is installed on the mounting frame and connected with the lower knife stand I.

Further, the cutting edge structures of the upper cutting edge I and the lower cutting edge I are dovetail cutting grooves or dovetail convex ribs; and the cutting edge structures of the upper cutting edge II and the lower cutting edge II are dovetail convex ribs or dovetail cutting grooves matched with the dovetail cutting grooves or the dovetail convex ribs.

Further, the cutting edge structures on the upper cutting edge II and the lower cutting edge II can pass through the cutting edge structures on the upper cutting edge I and the lower cutting edge I matched therewith; and at the same time, widths of the interlaced cutting edge structures of the upper cutting edge I and the lower cutting edge II are different, and widths of the interlaced cutting edge structures of the lower cutting edge I and the upper cutting edge II are different, so that the front and the rear slabs have extrusion deformation during cutting connection.

An intermediate blank connection method for hot-rolled strip headless rolling mainly comprises following steps:

(1) arranging two groups of cutting devices front and back along the operating direction of the unit: the cutting devices in the back comprise the upper cutting device II and the lower cutting device II which are arranged up and down oppositely, and the upper cutting device II and the lower cutting device II can make up and down motion; and the cutting devices in the front comprise the upper cutting device I and the lower cutting device I which are arranged up and down, and the upper cutting device I can make up and down motion and forward and backward motion along the operating direction of the unit respectively;

(2) arranging cutting edge structures of two groups of front and back cutting devices, wherein the cutting edge structure on the rear cutting device and the cutting edge structure on the front cutting device are interlaced, and when the rear cutting device rises and falls, the cutting edge structure thereon can pass through the cutting edge structure on the front cutting device;

(3) in the rear cutting device, matching the upper cutting device II with the lower cutting device II to clamp a strip tail of the front slab and lift the front slab; in the front cutting device, matching the upper cutting device I with the lower cutting device I to clamp a strip head of the rear slab; and matching the rear cutting device with the front cutting device to achieve that the strip tail of the front slab is located above the strip head of the rear slab and partially overlapped;

(4) declining the rear cutting device; matching the lower cutting device II with the upper cutting device I firstly to cut the front slab; and then matching the upper cutting device II with the lower cutting device I to cut the rear slab and synchronously realize connection.

Further, the widths of the cutting edge structures in the front and the rear cutting devices are controlled so that the front and the rear slabs have extrusion deformation during cutting connection.

Further, in the front cutting device, the lower cutting device I can also move front and back along the operating direction of the unit.

The present invention has the following beneficial effects:

The connection system and the connection method realize matching of an intermediate blank connection device and the speed of the unit through the translation drive system. The mounting frame is used to provide support for the cutting devices, and the cutting devices are divided into two groups arranged in the mounting frame to achieve clamping of the front slab and the rear slab respectively. The interlaced dovetail cutting edge structures are used to achieve cutting and ensure a good longitudinal stress state. Finally, a certain difference is set in sizes of width directions between the cutting edges, to ensure that there is certain extrusion deformation in a process of forming dovetail cutting groove connection, and enhance a connection effect. At the same time of realizing a good intermediate blank connection effect finally, a structure of the connection device is greatly simplified, and investment and operating cost is reduced.

Other advantages, objectives and features of the present invention will be illustrated in the following description to some extent, and will be apparent to those skilled in the art based on the following investigation and research to some extent, or can be taught from the practice of the present invention. The objectives and other advantages of the present invention can be realized and obtained through the following description.

BRIEF DESCRIPTION OF DRAWINGS

To enable the purpose, the technical solution and the advantages of the present invention to be more clear, the present invention will be preferably described in detail below in combination with the drawings, wherein.

Figure 1:
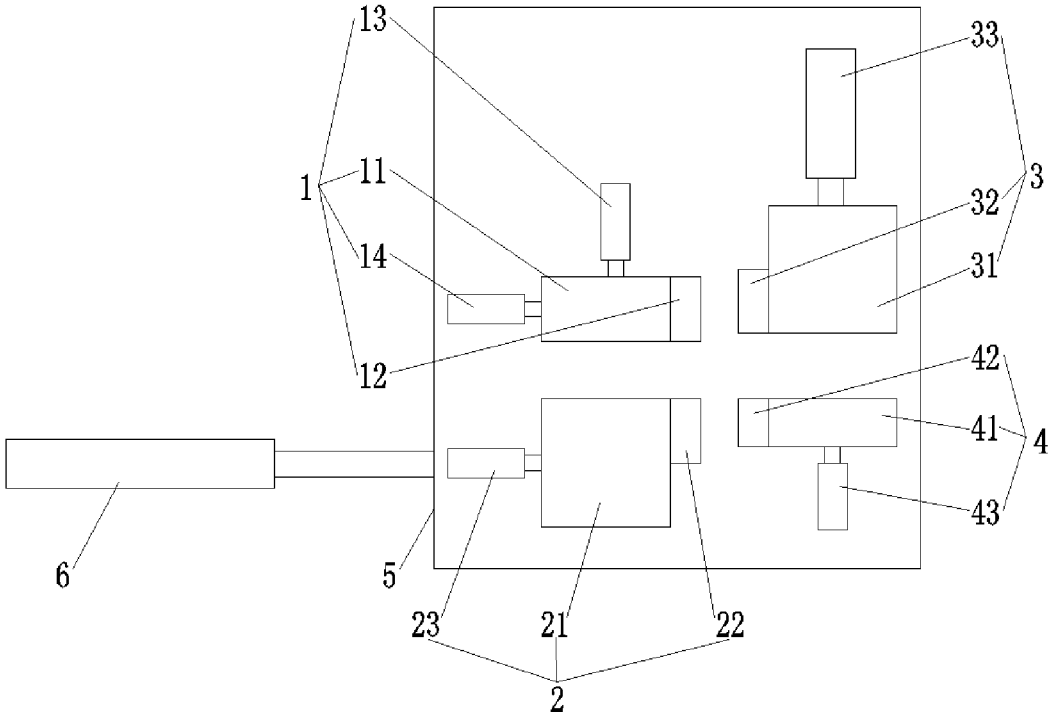
FIG. 1 is a structural schematic diagram of an intermediate blank connection system for hot-rolled strip headless rolling.

REFERENCE SIGNS upper cutting device I1, lower cutting device I2, upper cutting device I3, lower cutting device II4, mounting frame 5, and translation drive system 6;

in the upper cutting device I: upper knife stand I1, lower cutting edge I12, upper pressing mechanism I13, and upper translation mechanism I14;

in the lower cutting device I: lower knife stand I21, lower cutting edge I22, and lower translation mechanism I23;

in the upper cutting device II: upper knife stand II31, upper cutting edge II32, and upper pressing mechanism II33;

in the lower cutting device II: lower knife stand II41, lower cutting edge II42, and lifting mechanism 43.

DETAILED DESCRIPTION OF THE EMBODIMENTS OF THE INVENTION

Embodiments of the present invention are described below through specific embodiments. Those skilled in the art can understand other advantages and effects of the present invention easily through the disclosure of the description. The present invention can also be implemented or applied through additional different specific embodiments. All details in the description can be modified or changed based on different perspectives and applications without departing from the spirit of the present invention. It should be noted that the figures provided in the following embodiments only exemplarily explain the basic conception of the present invention, and if there is no conflict, the following embodiments and the features in the embodiments can be mutually combined.

Wherein the drawings are only used for exemplary description, are only schematic diagrams rather than physical diagrams, and shall not be understood as a limitation to the present invention. In order to better illustrate the embodiments of the present invention, some components in the drawings may be omitted, scaled up or scaled down, and do not reflect actual product sizes. It should be understandable for those skilled in the art that some well-known structures and description thereof in the drawings may be omitted.

Same or similar reference signs in the drawings of the embodiments of the present invention refer to same or similar components. It should be understood in the description of the present invention that terms such as "upper", "lower", "left", "right", "front" and "back" indicate direction or position relationships shown based on the drawings, and are only intended to facilitate the description of the present invention and the simplification of the description rather than to indicate or imply that the indicated device or element must have a specific direction or constructed and operated in a specific direction, and therefore, the terms describing position relationships in the drawings are only used for exemplary description and shall not be understood as a limitation to the present invention; for those ordinary skilled in the art, the meanings of the above terms may be understood according to specific conditions.

Figure 2:
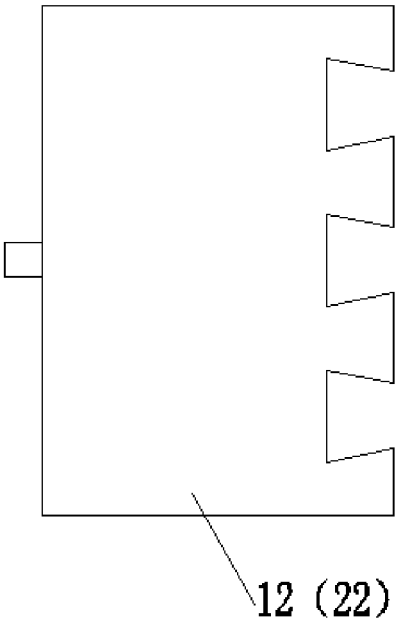
FIG. 2 is a structural schematic diagram of cutting edges of an upper cutting edge I and a lower cutting edge I.
Figure 3:
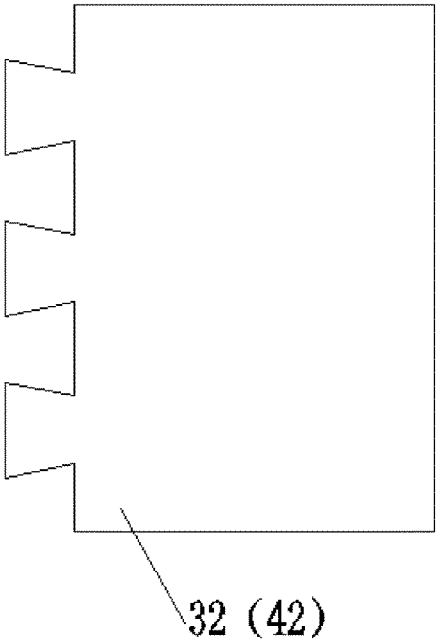
FIG. 3 is a structural schematic diagram of cutting edges of an upper cutting edge II and a lower cutting edge II.
Figure 4:
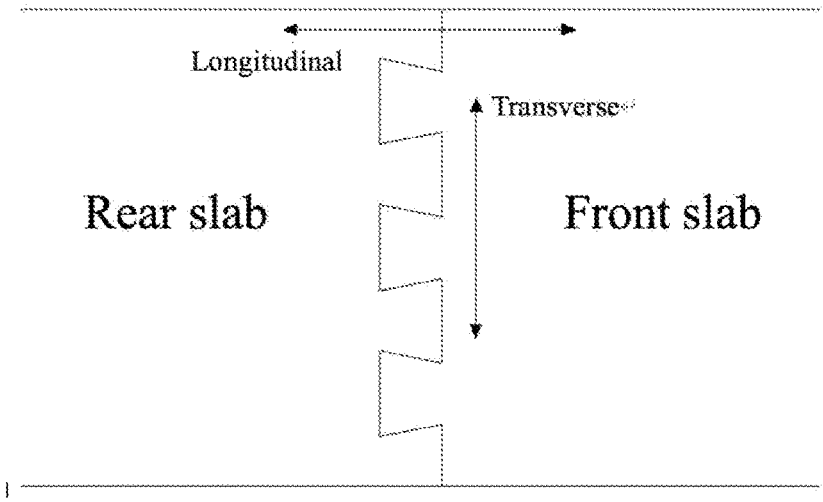
FIG. 4 is a connection diagram of a front slab and a rear slab.
Figure 5:
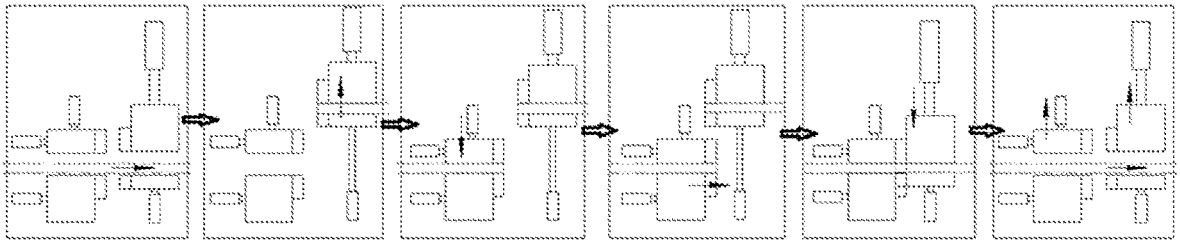
FIG. 5 is a schematic diagram of connection steps of an intermediate blank for hot-rolled strip headless rolling.

By referring to FIG. 1 to FIG. 5, an intermediate blank connection system for hot-rolled strip headless rolling comprises an upper cutting device I1, a lower cutting device I2, an upper cutting device II3 and a lower cutting device II4; and the upper cutting device II3 and the lower cutting device II4 are located behind the upper cutting device I1 and the lower cutting device I2.

In the present embodiment, the upper cutting device I1 comprises an upper knife stand I11, an upper cutting edge I12 arranged on the upper knife stand I11, an upper pressing mechanism I13 for driving the upper knife stand I11 to make up and down motion, and an upper translation mechanism I14 for driving the upper knife stand I to make forward and backward translational motion. The upper cutting edge I12 and the upper knife stand I11 can be driven by the upper translation mechanism I14 to move forward and backward along an operating direction of a unit; the upper cutting edge I12 and the upper knife stand I11 can also be driven by the upper pressing mechanism I13 to move up and down; and slabs can be clamped under cooperation of the lower cutting device I through the forward and backward motion and the up and down motion.

The lower cutting device I2 is mainly comprised of a lower knife stand I21 and a lower cutting edge I22 arranged on the lower knife stand I21. When arranged near the lower cutting device II4, the lower cutting device I2 can be arranged fixedly to realize mutual cooperation through motion of the upper cutting device I1. When arranged at a distance from the lower cutting device II4, the lower cutting device I also comprises a lower translation mechanism I23 for driving the lower knife stand I21 to make forward and backward translation motion. In this way, the upper cutting device I1 and the lower cutting device I2 can realize forward and backward motion of the upper knife stand I11 and the lower knife stand I21 correspondingly through the upper translation mechanism I14 and the lower translation mechanism I23, so as to cooperate with the rear cutting device.

Accordingly, the upper cutting device II3 comprises an upper knife stand II31, an upper cutting edge II32 arranged on the upper knife stand II31, and an upper pressing mechanism II33 for driving the upper knife stand II to make up and down motion. The lower cutting device II4 comprises a lower knife stand II41, a lower cutting edge II42 arranged on the lower knife stand II41, and a lifting mechanism 43 for driving the lower knife stand II to make up and down motion. The upper knife stand II is driven by the upper pressing mechanism II33 to make up and down motion, and the lower knife stand II41 is driven by the lifting mechanism 43 to make up and down motion, so that the upper knife stand II is matched with the lower knife stand II41 to clamp the slabs.

Here, the upper cutting device II3 and the lower cutting device II4 are arranged behind the upper cutting device I1 and the lower cutting device I2; and the upper cutting device I1 and the lower cutting device I2 can realize forward and backward motion of the upper knife stand I11 and the lower knife stand I21 correspondingly through the upper translation mechanism I14 and the lower translation mechanism I23. In this way, under adjustment of lifting and motion, the slabs can be clamped and superimposed and the cutting edges on the knife stands can be matched with each other, so as to realize cutting connection of the slabs.

Specifically, the upper cutting edge I12 is arranged above the lower cutting edge I22 and the upper cutting edge I12 has a same cutting edge structure as the lower cutting edge I22; the upper cutting edge II32 is arranged directly above the lower cutting edge II42 and the upper cutting edge II32 has a same cutting edge structure as the lower cutting edge II42; the cutting edge structures of the upper cutting edge I and the lower cutting edge II are interlaced with each other, and the cutting edge structures of the lower cutting edge I and the upper cutting edge II are interlaced with each other. A cutting process is realized through cooperation of two groups of cutting devices arranged front and back, and at the same time of cutting, connection is realized synchronously.

As further improvement of the above solution, the intermediate blank connection system for hot-rolled strip headless rolling further comprises a mounting frame 5 and a translation drive system 6; the translation drive system 6 is connected with the mounting frame 5 and drives the mounting frame to move forward and backward along the operating direction of the unit; and the upper cutting device I1 and the lower cutting device I2 are arranged on the mounting frame and located at an inlet end, and the upper cutting device II3 and the lower cutting device II4 are arranged in the mounting frame 5 and located at an outlet end.

Specifically, in the upper cutting device I1, the upper pressing mechanism I13 is installed on the upper translation mechanism I14 and is connected with the upper knife stand I11, and the upper translation mechanism I14 is installed above an inlet side of the mounting frame. The upper knife stand Ill can be driven by the upper pressing mechanism I13 and the upper translation mechanism I14 to move up and down and forward and backward correspondingly in the mounting frame. In the lower cutting device I2, the lower knife stand I21 is installed on the lower translation mechanism I23 and driven by the lower translation mechanism; and the lower translation mechanism I23 is installed below the inlet side of the mounting frame. In the upper cutting device II3, the upper pressing mechanism II33 is correspondingly connected with the upper knife stand II31 and installed above an outlet side of the mounting frame; and the upper knife stand II31 is driven by the upper pressing mechanism II33 to move up and down in the mounting frame. In the lower cutting device II4, the lower knife stand II41 is installed below the outlet side of the mounting frame by the lifting mechanism 43, and the lower knife stand II41 and the cutting edge thereon can be driven by the lifting mechanism 43 to move up and down in the mounting frame.

Preferably, the upper pressing mechanism II33 is provided with a press quantity detection device for accurately controlling the cutting quantity of the cutting edges to adapt to requirements for thickness of different slabs.

The above mounting frame 5 is used for providing support for the upper cutting device I1, the lower cutting device I2, the upper cutting device II3 and the lower cutting device II4. The translation drive system 6 is used for driving the mounting frame 5 to move along the operating direction of the unit in a process of intermediate blank connection. Each mechanism can be controlled by the translation drive system 6 to move with the mounting frame along the operating direction of the unit. A displacement detection device is arranged in the translation drive system 6, and used to control moving speed of the mounting frame 5 in real time to match the moving speed with the speed of the unit, so as to facilitate accurate connection of the intermediate blank.

In the present embodiment, the cutting edge structures of the upper cutting edge I12 and the lower cutting edge I22 are dovetail cutting grooves; and the cutting edge structures of the upper cutting edge II and the lower cutting edge II are dovetail convex ribs matched with the dovetail cutting grooves. In a cutting process, the upper cutting device I1 is firstly matched with the lower cutting device II4 to cut a front slab; and then the upper cutting device II3 is matched with the lower cutting device I2 to cut a rear slab and connection is synchronously realized. Namely, both are mutually interlaced to realize matching connection. Of course, the cutting edge structures here are not limited to a dovetail form, but other cutting edge structural forms that can realize transverse (a slab width direction) staggered connection and longitudinal (a slab length direction) anti-falling can also be used.

Preferably, widths of the interlaced cutting edge structures on the upper cutting edge I12 and the lower cutting edge II42 are different, and widths of the interlaced cutting edge structures on the lower cutting edge I22 and the upper cutting edge II32 are different. Namely, sizes of the cutting edges of the upper cutting device I1 and the lower cutting device II4 and the cutting edges of the upper cutting device II3 and the lower cutting device I2 in width directions are different. In this way, tooth grooves on the front slab and tooth grooves on the rear slab are overlapped partly so that the formed dovetail cutting grooves have certain extrusion deformation in a connection process, which can enhance a connection effect.

It should be noted that the pressing mechanisms, the translation mechanisms, the translation drive systems and the lifting mechanisms mentioned in the solution are existing linear telescopic drive mechanisms, such as hydraulic cylinders.

An intermediate blank connection method for hot-rolled strip headless rolling mainly comprises following steps:

(1) Arranging two groups of cutting devices front and back (the inlet side and the outlet side) in the same mounting frame: the cutting devices located at the outlet side comprise the upper cutting device II and the lower cutting device II which are arranged up and down oppositely, and the upper cutting device II and the lower cutting device II can make up and down motion; and the cutting devices located at the inlet side comprise the upper cutting device I and the lower cutting device I which are arranged up and down, and the upper cutting device I can make up and down motion and forward and backward motion along the operating direction of the unit respectively; and the mounting frame is driven by the translation drive system to move along the operating direction of the unit.

(2) Arranging cutting edge structures of two groups of front and back cutting devices, wherein the cutting edge structures on the rear upper cutting device II and the rear lower cutting device II are identical, the cutting edge structures on the front upper cutting device I and the front lower cutting device I are identical, and the front and the rear cutting edge structures are mutually interlaced; and when the rear cutting device rises and falls, the cutting edge structure thereon can pass through the cutting edge structure on the front cutting device.

(3) In the rear cutting device, matching the upper cutting device II with the lower cutting device II to clamp a strip tail of the front slab and lift the front slab; in the front cutting device, matching the upper cutting device I with the lower cutting device I to clamp a strip head of the rear slab; and matching the rear cutting device with the front cutting device to achieve that the strip tail of the front slab is located above the strip head of the rear slab and partially overlapped.

(4) Declining the rear cutting device; matching the lower cutting device II with the upper cutting device I firstly to cut the front slab; and then matching the upper cutting device II with the lower cutting device I to cut the rear slab and synchronously realize connection.

Preferably, the widths of the cutting edge structures in the front and the rear cutting devices are controlled so that the front and the rear slabs have extrusion deformation during cutting connection.

Preferably, in the front cutting device, the lower cutting device I can also move front and back along the operating direction of the unit.

Specifically, the method includes following stages:

(1) The upper cutting device I and the lower cutting device I, the upper cutting device II and the lower cutting device II are in an open state, and the intermediate blank passes through a middle of the connecting system.

(2) The upper cutting device II and the lower cutting device II are driven to match with each other to press the strip tail of the front slab; under the action of the upper pressing mechanism I133 and the lifting mechanism 43, the front slab is lifted by certain height under a pressed state; and at the same time, the translation drive system 6 controls the mounting frame to move, and moving speed is matched with the speed of the unit.

(3) The upper cutting device I and the lower cutting device I are driven to match with each other to press the strip head of the rear slab.

(4) Under the drive of the upper translation mechanism I14 and the lower translation mechanism I23, the upper cutting device I and the lower cutting device I are synchronously moved together with the rear slab, so that the strip head of the rear slab pressed between the upper cutting device I and the lower cutting device I is in a corresponding position below the strip tail of the front slab.

(5) The upper cutting device II and the lower cutting device II in which the strip tail of the front slab is pressed are driven to synchronously move downward: the lower cutting edge II in the lower cutting device II is firstly matched with the upper cutting edge I in the upper cutting device I to cut the strip tail of the front slab; and then the upper cutting edge II in the upper cutting device II is subsequently matched with the lower cutting edge I in the lower cutting device I to cut the strip head of the rear slab; and when the strip head of the rear slab is cut, the cut strip tail of the front slab is synchronously connected with the strip tail of the front slab after cut.

(6) The upper cutting device I, the lower cutting device I, the upper cutting device II and the lower cutting device II are driven to release the pressed state for the front slab and the rear slab, and each mechanism is reset to the state of stage (1) to wait for next cutting.

The connection system and the connection method realize matching of an intermediate blank connection device and the speed of the unit through the translation drive system. The mounting frame is used to provide support for the cutting devices (the upper cutting device I1, the lower cutting device I2, the upper cutting device II3 and the lower cutting device II4), and the upper cutting device I1, the lower cutting device I2, the upper cutting device II3 and the lower cutting device II4 are divided into two groups arranged in the mounting frame to achieve clamping of the front slab and the rear slab respectively. The interlaced dovetail cutting edge structures are used to achieve cutting and ensure a good longitudinal stress state. Finally, a certain difference is set in sizes of width directions between the cutting edges, to ensure that there is certain extrusion deformation in a process of forming dovetail cutting groove connection, and enhance a connection effect. At the same time of realizing a good intermediate blank connection effect finally, a structure of the connection device is greatly simplified, and investment and operating cost is reduced.

Finally, it should be noted that the above embodiments are only used for describing, rather than limiting the technical solution of the present invention. Although the present invention is described in detail with reference to the preferred embodiments, those ordinary skilled in the art shall understand that the technical solution of the present invention can be amended or equivalently replaced without departing from the purpose and the scope of the technical solution. The amendment or equivalent replacement shall be covered within the scope of the claims of the present invention.

What is claimed is:

1. An intermediate blank connection system for hot-rolled strip headless rolling, characterized by comprising an upper cutting device I, a lower cutting device I, an upper cutting device II and a lower cutting device II; the upper cutting device II and the lower cutting device II are located behind the upper cutting device I and the lower cutting device I;

the upper cutting device I comprises an upper knife stand I, an upper cutting edge I arranged on the upper knife stand I, an upper pressing mechanism I for driving the upper knife stand I to make up and down motion, and an upper translation mechanism I for driving the upper knife stand I to make forward and backward translational motion; the lower cutting device I is mainly comprised of a lower knife stand I and a lower cutting edge I arranged on the lower knife stand I;

the upper cutting device II comprises an upper knife stand II, an upper cutting edge II arranged on the upper knife stand II, and an upper pressing mechanism II for driving the upper knife stand II to make up and down motion; the lower cutting device II comprises a lower knife stand II, a lower cutting edge II arranged on the lower knife stand II, and a lifting mechanism for driving the lower knife stand II to make up and down motion;

the upper cutting edge I is arranged above the lower cutting edge I and the upper cutting edge I has a same cutting edge structure as the lower cutting edge I; the upper cutting edge II is arranged directly above the lower cutting edge II and the upper cutting edge II has a same cutting edge structure as the lower cutting edge II; the cutting edge structures of the upper cutting edge I and the lower cutting edge II are interlaced with each other to cut a front slab under cooperation, and the cutting edge structures of the lower cutting edge I and the upper cutting edge II are interlaced with each other to cut a rear slab under cooperation; and the upper pressing mechanism II is provided with a press quantity detection device for controlling the cutting amount of the upper cutting edge II and the lower cutting edge II.

2. The intermediate blank connection system for hot-rolled strip headless rolling according to claim 1, characterized by further comprising a mounting frame and a translation drive system; the translation drive system is connected with the mounting frame and drives the mounting frame to move forward and backward along an operating direction of a unit; the translation drive system is provided with a displacement detection device for controlling moving speed of the mounting frame in real time, so that the mounting frame is matched with speed of the unit; the upper cutting device I and the lower cutting device I are arranged on the mounting frame and located at an inlet end, and the upper cutting device II and the lower cutting device II are arranged on the mounting frame and located at an outlet end.

3. The intermediate blank connection system for hot-rolled strip headless rolling according to claim 2, characterized in that the upper pressing mechanism I is installed on the upper translation mechanism I and is connected with the upper knife stand I, and the upper translation mechanism I is installed on the mounting frame; and the upper pressing mechanism II and the lifting mechanism are correspondingly connected with the upper knife stand II and the lower knife stand II and installed on the mounting frame.

4. The intermediate blank connection system for hot-rolled strip headless rolling according to claim 2, characterized in that the lower cutting device I also comprises a lower translation mechanism I for driving the lower knife stand I to make forward and backward translation motion.

5. The intermediate blank connection system for hot-rolled strip headless rolling according to claim 4, characterized in that the lower translation mechanism I is installed on the mounting frame and connected with the lower knife stand I.

6. The intermediate blank connection system for hot-rolled strip headless rolling according to claim 1, characterized in that the cutting edge structures of the upper cutting edge I and the lower cutting edge I are dovetail cutting grooves or dovetail convex ribs; and the cutting edge structures of the upper cutting edge II and the lower cutting edge II are dovetail convex ribs or dovetail cutting grooves matched with the dovetail cutting grooves or the dovetail convex ribs.

7. The intermediate blank connection system for hot-rolled strip headless rolling according to claim 1 or 6, characterized in that the cutting edge structures on the upper cutting edge II and the lower cutting edge II can pass through the cutting edge structures on the upper cutting edge I and the lower cutting edge I matched therewith; and at the same time, widths of the interlaced cutting edge structures of the upper cutting edge I and the lower cutting edge II are different, and widths of the interlaced cutting edge structures of the lower cutting edge I and the upper cutting edge II are different, so that the front and the rear slabs have extrusion deformation during cutting connection.

8. An intermediate blank connection method for hot-rolled strip headless rolling, characterized by mainly comprising following steps:

(1) arranging two groups of cutting devices front and back along an operating direction of a unit: the cutting devices in the back comprise an upper cutting device II and a lower cutting device II which are arranged up and down oppositely, and the upper cutting device II and the lower cutting device II can make up and down motion; and the cutting devices in the front comprise an upper cutting device I and a lower cutting device I which are arranged up and down, and the upper cutting device I can make up and down motion and forward and backward motion along the operating direction of the unit respectively;

(2) arranging cutting edge structures of two groups of front and back cutting devices, wherein the cutting edge structure on the rear cutting device and the cutting edge structure on the front cutting device are interlaced, and when the rear cutting device rises and falls, the cutting edge structure thereon can pass through the cutting edge structure on the front cutting device;

(3) in the rear cutting device, matching the upper cutting device II with the lower cutting device II to clamp a strip tail of a front slab and lift the front slab; in the front cutting device, matching the upper cutting device I with the lower cutting device I to clamp a strip head of a rear slab; and matching the rear cutting device with the front cutting device to achieve that the strip tail of the front slab is located above the strip head of the rear slab and partially overlapped;

(4) lowering the rear cutting device to make heights of the front slab and the rear slab consistent; during this time, matching the lower cutting device II with the upper cutting device I firstly to cut the front slab; and then matching the upper cutting device II with the lower cutting device I to cut the rear slab and synchronously realize connection of the front slab and the rear slab.

9. The intermediate blank connection method for hot-rolled strip headless rolling according to claim 8, characterized in that the widths of the cutting edge structures in the front and the rear cutting devices are controlled so that the front and the rear slabs have extrusion deformation during cutting connection.

10. The intermediate blank connection method for hot-rolled strip headless rolling according to claim 8, characterized in that in the front cutting device, the lower cutting device I can also move front and back along the operating direction of the unit.

* * * * *